US005587266A

United States Patent [19]

Ujihara et al.

[11] Patent Number: 5,587,266

[45] Date of Patent: Dec. 24, 1996

[54] MANUFACTURING METHOD FOR AN ELECTROPHOTOGRAPHIC PHOTORECEPTOR

[75] Inventors: Junji Ujihara; Akira Ohira, both of Hachioji, Japan

[73] Assignee: Konica Corporation, Tokyo, Japan

[21] Appl. No.: 521,975

[22] Filed: Aug. 31, 1995

[30] Foreign Application Priority Data

Sep. 6, 1994 [JP] Japan ..... 6-212675

[51] Int. Cl.$^6$ ..... G03G 5/04

[52] U.S. Cl. ..... 430/133

[58] Field of Search ..... 427/428; 430/133

[56] References Cited

U.S. PATENT DOCUMENTS 5,494,711 2/1996 Seki et al. ..... 430/133

FOREIGN PATENT DOCUMENTS 56-15866 2/1981 Japan .
58-189061 11/1983 Japan .
6095546 5/1985 Japan ..... 430/133
1-242165 9/1989 Japan .
3-118866 5/1991 Japan .
3-118867 5/1991 Japan .
3-72350 11/1991 Japan .
3-274564 12/1991 Japan .
6-7265 1/1994 Japan .

*Primary Examiner*—John Goodman
*Attorney, Agent, or Firm*—Frishauf, Holtz, Goodman, Langer & Chick, P.C.

[57] ABSTRACT

A method of manufacturing an electrophotographic receptor drum, has the following steps. Cylinder shafts of a plurality of cylindrical drums are aligned with each other; and circular ends of the drums are contacted with each other and the drums are stacked on each other. Photoreceptor material is continuously coated on circumferential surfaces of the drums while the drums are inserted into a ring-shaped coater and the ring-shaped coater is moved vertically from an upper portion to a lower portion of the stacked drums. Each of the drums satisfying the following inequalities at the same time is used for the coating:

$$30° \leqq \theta \leqq 80°, \text{ and } 0.01 \text{ mm} \leqq l \leqq 0.3 \text{ mm}$$

where θ represents an angle between an extension line of a chamfering face formed at an edge of the drum and an extension line of a circular end of the drum, and l represents a distance between an intersecting point of the circular end and the chamfering face of the drum, and an extension line of a circumferential surface of the drum.

4 Claims, 3 Drawing Sheets

MANUFACTURING METHOD FOR AN ELECTROPHOTOGRAPHIC PHOTORECEPTOR

BACKGROUND OF THE INVENTION

The present invention relates to obtaining an electrophotographic photoreceptor by continuously coating liquid photosensitive material on the circumferential surfaces of a plurality of cylindrical drums, and to a manufacturing method for the electrophotographic photoreceptor drum.

As a method for manufacturing an electrophotographic photoreceptor by coating a photoreceptor solution onto the outer surface of a cylindrically formed drum, a spray coating method, a dip coating method, a blade coating method, a roll coating method, etc., are previously known.

On the other hand, a slide hopper coating method for coating a photoreceptor solution onto the circumference of a cylindrical drum by moving a scraper blade located around the drum, with a certain clearance with respect to a drum surface, has been proposed in Japanese Patent Publication Open to Public Inspection No. 15866/1981, and Japanese Patent Examined Publication Nos. 72350/1991 and 7265/1994.

Further, a continuous coating method in which a connecting member is provided on a cylindrical drum, or a continuous coating method in which no connecting member is used, has been proposed in Japanese Patent Publication Open to Public Inspection Nos. 242165/1989, 118866/1991, 118867/1991 and 274564/1991.

Further, as an improved method of the above proposals, an apparatus for coating a photosensitive solution onto the outer surface of a cylindrical drum is proposed in Japanese Patent Publication Open to Public Inspection No. 189061/1983. That apparatus comprises: a coating solution distribution slit formed continuously around the outer peripheral surface of the cylindrical drum; a solution slide surface, formed continuously inclined toward the lower side of the outlet for the coating solution of the coating solution distribution slit, the solution slide surface having an end portion, the diameter of which is slightly larger than that of the outer periphery of the cylindrical drum; and a lip-shaped portion extending from the end portion of the slide surface to the lower portion of the apparatus.

Further, conventionally, as to the shape of the electrophotographic photoreceptor, there are a sheet type photoreceptor and a cylindrical drum type photoreceptor. In the sheet type photoreceptor, a photosensitive solution is coated onto a resin film or aluminum foil by methods such as roll-coating, bar-coating, knife-coating, or blade-coating, etc. In the cylindrical drum type photoreceptor, a photosensitive solution is coated onto the cylindrical drum surface formed of stainless steel, aluminum, copper, brass, or plastic material, and as a coating method, a bead-coating method is proposed which has a slide surface represented by the method disclosed in Japanese Patent Publication Open to Public Inspection No. 189061/1983.

In the above-described spray-coating method, solvents included in a photosensitive solution are evaporated before the photosensitive solution jetted from a spray gun reaches the outer surface of the object to be coated, and dried particles adhere onto the surface of the object to be coated. Accordingly, a coated surface having the required smoothness can not be obtained, and controlling the film thickness of the photoreceptor layer is difficult. Further, in the blade-coating method and roll-coating method, a uniform coating film can not be obtained due to the viscosity of the coating solution, which is a disadvantage. Still further, in the dip-coating method, surface smoothness of the coating film, and uniformity of the coating film, described above, are improved, however, the film thickness depends on the physical properties of the coating solution and the coating speed. Accordingly, adjustment of the coating solution is very important, however, this adjustment is very difficult in practice. Further, the coating speed is slow, resulting in lower productivity.

Normally, cutting is performed on the end surface of the cylindrical drum of the object to be coated. At the cutting portion, disturbance of the coating solution occurs just below the portion joined to the following cylindrical drum, resulting in non-uniformly coated film and further loss of beads, which is disadvantageous.

SUMMARY OF THE INVENTION

The present invention is specifically investigated to improve the foregoing disadvantages. An object of the present invention is to provide a manufacturing method for a photoreceptor in which a coating solution such as a photosensitive solution is uniformly and effectively coated on the surface of a cylindrical drum for the photoreceptor, and in which a photoreceptor material is formed with a uniform photoreceptor film, specifically on the cylindrical drum in which chamfering is conducted on its edge, so that desired images can be obtained on the photoreceptor. A further object of the present invention is to provide a manufacturing method for a photoreceptor in which unacceptable coating does not occur even when a photoreceptor film is continuously coated on a plurality of cylindrical drums.

The object of the present invention is accomplished by a manufacturing method for an electrophotographic photoreceptor, including processes in which: axes of a plurality of cylindrical drums are aligned with each other; a plurality of drums are superimposed such that one end portion of one cylindrical drum is in contact with one end of the other drum; the cylindrical drums are inserted into a ring-shaped coating means by which a coating solution is supplied onto the surfaces of the moving drums; and the coating solution is continuously coated on the cylindrical drums, wherein the cylindrical drum has a cut surface on its peripheral end portion, the angle ($\theta$) formed between the cut surface of the peripheral end portion and the horizontal surface in the direction of the diameter of the drum is between 30° through 80°, and the length (l) between the outer peripheral surface of the drum, on the horizontal surface, and the intersection of the cut surface and horizontal surface is not more than 0.3 mm.

In the present invention, although an angle ($\theta$) formed between the cut surface of the peripheral end portion and the horizontal surface in the direction of the diameter of the drum is between 30° through 80°, it is preferable that a larger angle ($\theta$), that is, 45° through 80° is preferable. Further, although the length (l) between the outer peripheral surface of the drum, on the horizontal surface, and the intersection of the cut surface and horizontal surface, that is, the length to the horizontal surface from the outer peripheral surface of the drum, is not more than 0.3 mm, longitudinal streaks easily occur due to so-called burr when the length (l) is too small. Accordingly, it is preferable that the length (l) is not less than 0.01 mm, and specifically, that it is within the range of 0.01 through 0.2 mm.

In the present invention, a coating solution coated onto the surface of the cylindrical drum is normally coated on an organic electrophotographic photoreceptor, and is used for forming a photosensitive layer such as a charge generation layer (CGL), a charge transport layer (CTL), an intermediate layer such as an under-coat layer, and a protective layer. This coating solution is optionally used as necessary.

As a coating method of the present invention, a so-called circular sliding hopper coating method is optimum, by which a photosensitive layer, and the like, are coated on the cylindrical drum, and which is similar to the methods disclosed in Japanese Patent Publication Open to Public Inspection No. 15866/1981, Japanese Patent Examined Publication Nos. 72350/1991 and 7265/1994. In this case, the CGL and CTL can be simultaneously coated such that these layers are superimposed, and the coating method of the present invention is satisfactorily adopted into the coating process.

The coating method of the present invention is preferably applied for the method in which a thin layer of the CGL, the dried film thickness of which is approximately 1 μm, is coated at high speed as a mono-layer, or coated as multi-layers simultaneously with other layers.

As a coating solution in the present invention, a conventional coating solution, adopted in the OPC, is optionally used for forming the CGL and CTL.

DETAILED DESCRIPTION OF THE PREFERRED EMBODIMENT

Figure 1:
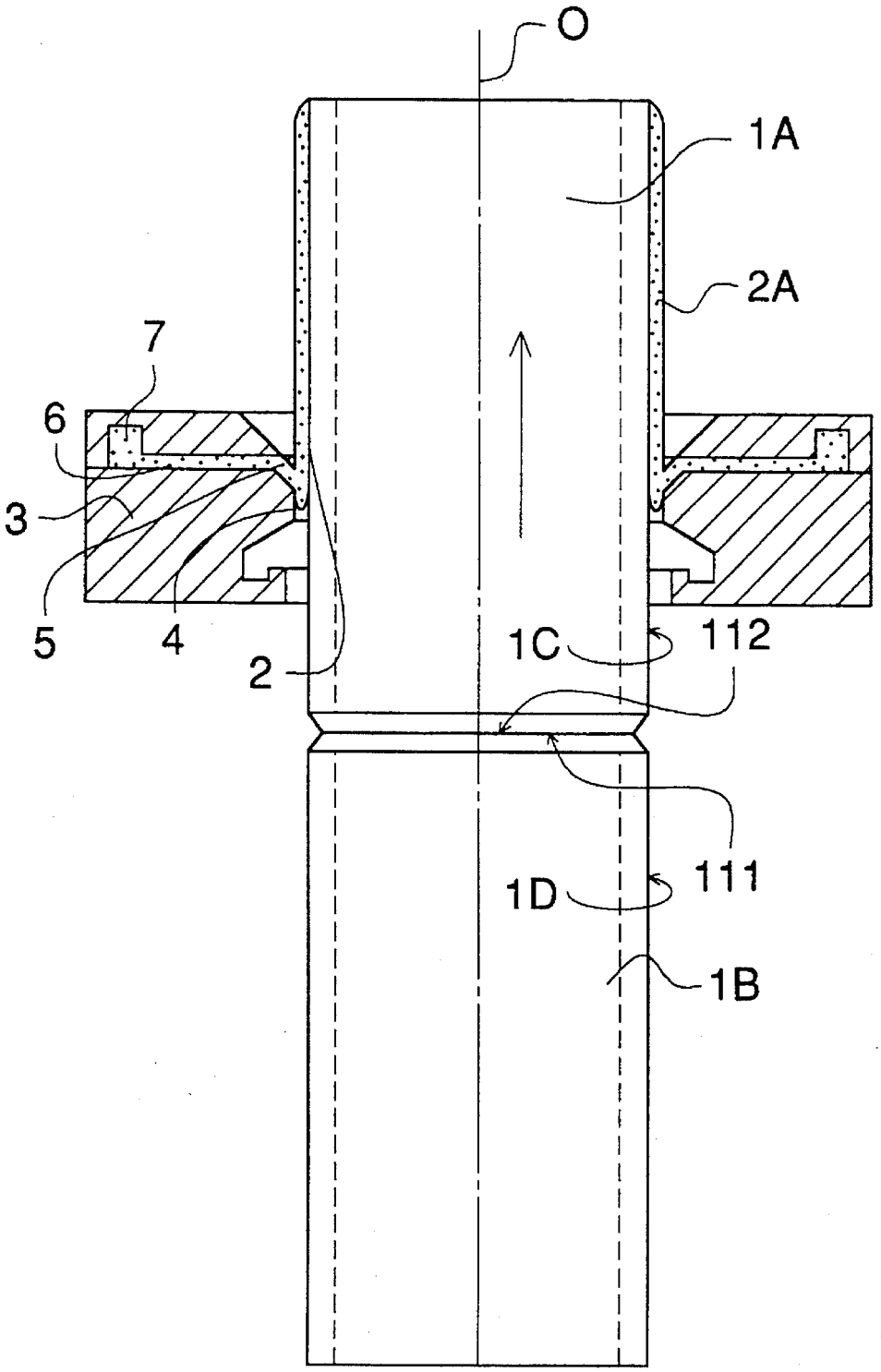
FIG. 1 is a front view showing the condition that a coating solution is coated onto the surface of a cylindrical drum by the method of the present invention.

FIG. 1 is an example of the method of the present invention, and an example in which a coating solution 2 is coated on surfaces 1C and 1D of cylindrical drums 1A and 1B by using a ring-shaped coating apparatus 3, wherein the cylindrical drums 1A and 1B are vertically stacked along center line O (cylindrical axis), and the horizontal surface 111 of the cylindrical drum A is in contact with the horizontal surface 112 of the cylindrical drum 1B in such a manner that the cylindrical axes of two drums are aligned with each other. As shown in the drawing, a coating head 4 for the coating solution 2 is formed such that the cylindrical drum 1A is surrounded by the coating head, so that the photosensitive solution 2 supplied to the coating head 4 is coated onto the surface 1C of the cylindrical drum 1A. As a coating method, the ring-shaped coating apparatus 3 is fixed, and the cylindrical drum 1A is moved upward along the center line O in the arrowed direction, so that coating is carried out from the upper to the lower end portion of each cylindrical drum 1A. A narrow horizontal slit 6 for distributing the coating solution, which is open to the surface 1C of the cylindrical drum 1A, and has an exit 5 for supplying the coating solution to the surface of the cylindrical drum 1A, is formed in the coating head 4. This slit 6 communicates with a reservoir header 7. When the coating solution 2 is supplied to the reservoir header 7 by a feed pump (not shown in the drawing), a predetermined amount of the coating solution 2 is stably fed to the exit 5 for coating solution, a coating operation is carried out on the surface 1C of the cylindrical drum 1A, and a coating layer 2A is formed. In the coating film on the surface of the cylindrical drum 1A on which the coating solution 2A has been coated, since a large amount of coating solvents are included in the coating solution 2 and the coating solution 2 is diluted, a part of the coating solution 2, coated on the upper end portion of the cylindrical drum, tends to flow downward and forms coating solution beads.

Figure 2:
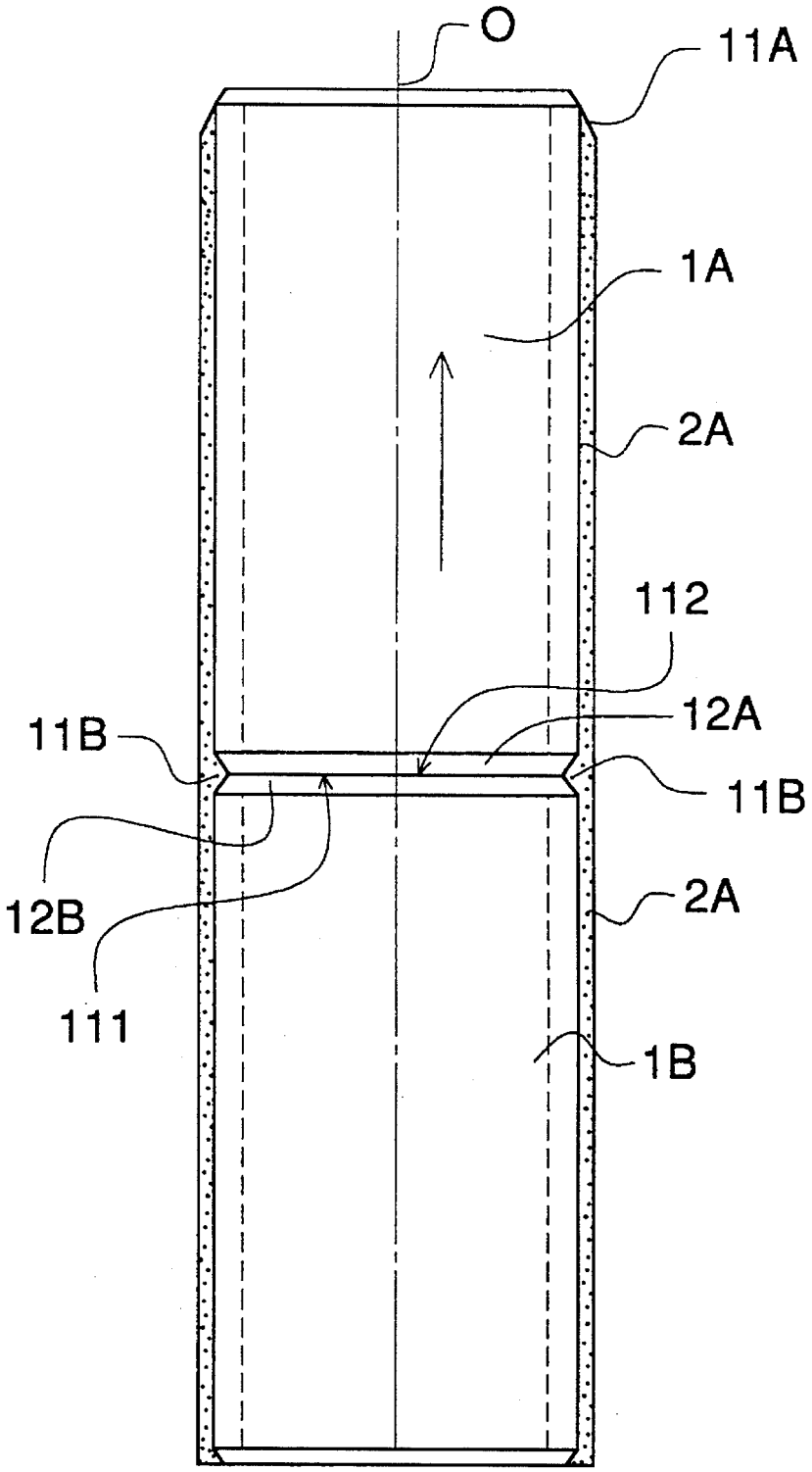
FIG. 2 is a front view showing the condition that a coating solution is coated on a plurality of cylindrical drums by the method shown in FIG. 1.
Figure 3:
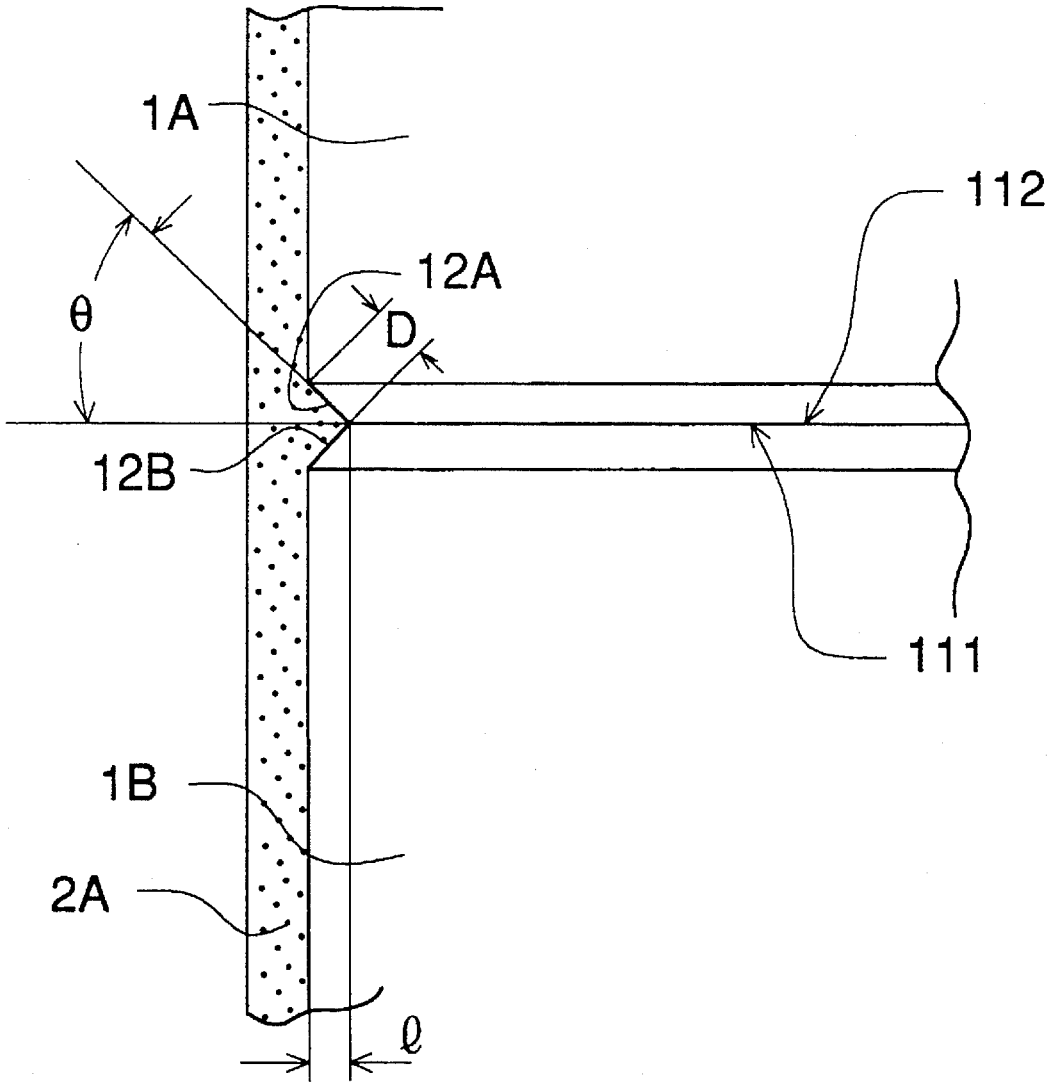
FIG. 3 is a sectional view showing a cut surface formed on the ends of cylindrical drums used for the method of the present invention.

As shown in FIG. 2, a cut surface 12A is formed on the horizontal surface 111 of the cylindrical drum 1A, and another cut surface 12B is formed on the opposite horizontal surface 112 of the cylindrical drum 1B. When the horizontal surface 111 of the cylindrical drum 1A is connected to the horizontal surface 112 of the cylindrical drum 1B, a groove 11B is formed by cut surfaces 12A and 12B. FIG. 2 shows the condition that a coating solution is coated on cylindrical drums 1A and 1B by the method shown in FIG. 1. FIG. 2 shows an example in which a coating solution layer is formed in the arrowed direction in the drawing. In FIG. 2, the cylindrical drum 1A and the cylindrical drum 1B are moved upward in the arrowed direction, and coating is completed. In this case, a reservoir of the coating solution 2 is generated at the connected portion of the cylindrical drums 1A and 1B. In the method of the present invention, the solution pooled in this reservoir enters the groove 11B. Even in this case, the coating solution 2 is uniformly coated on the drum as shown in the drawing by the method of the present invention.

The necessity of and problems related to the groove 11B will be described below. Generally, in a cylindrically formed structure, the edge of its outer periphery is sharp and potentially dangerous during the cutting processing of the end surface (the surface perpendicular to the cylindrical axis) or in the finishing processing. Accordingly, the cutting portion is chamfered to remove this sharp edge, and the chamfered shape (the cut surface) is formed. However, as described above, in the case where the coating solution 2 is coated so as to form the coating layer 2A while the cylindrical drums 1A and 1B are connected vertically to each other and moved upward, when the cut surfaces 12A and 12B are formed to be larger, the coating solution 2 enters the groove, formed by the cut surfaces, with more than the required amount. In this case, since the rate of drying of this coating solution is lower than that of the other coated portion after coating, the solution drips, or sufficient supply of the coating solution is delayed and the coating film is lost, resulting in non-uniform coating.

That is, coating problems occur such that: the thickness of the coated film on the lower end portion of the cylindrical drum 1A decreases, and the thickness of the coated film on the upper end portion of the cylindrical drum 1B increases. Furthermore, formation of the bead on the cut surfaces 12A and 12B becomes unstable, and further, the bead is lost in extreme cases, so that a uniform coating film is not formed.

In order to solve the above problems, the following method is adopted in the present invention. In the case where the angle formed between the cut surface 12A and the outer peripheral surface of the cylindrical drums 1A and 1B (the horizontal surface 112), is defined as θ, and the angle formed between the horizontal surface 111 of the cylindrical drum 1A and the cut surface 12A is defined as θ, the above problems can be solved when this angle θ is in the range of 30° to 80°. As a result of the investigation by the inventors, the above problems can not be solved only by reducing the dimensions of the groove 11B, however the problems can be solved by the method of the present invention.

EXAMPLE 1

As the coating solution 2, CGL-1 coating solution components [viscosity of 10 centipoise (cp)], in which 2.5 w/v% solid matter content was included, having the composition in the following note (1), were used in this example. A ring-shaped coating apparatus 3 shown in FIG. 1 was used, and coating was carried out at a coating speed of 15 mm/sec and the coated solution was dried to result in a final thickness of the dried film of 1.0 μm.

The cylindrical drums 1A and 1B to be coated were aluminum drums having the following dimensions: the diameter is 80 mm, the length is 355.5 mm, the thickness of the peripheral wall is 1.25 mm, and the length (l) of the cut surface is 0.1 mm. The angle (θ) formed between the cut surface and the horizontal surface in the direction of the diameter of the drum was changed from 25° to 85°. Results obtained in this example are shown in Table 1.

| | |
|---|---|
| Note (1) CGL-L coating solution components | |
| Fluorenon type disazo pigment (CGM-1) | 200 g |
| Butyral resin (S-lec) BX-L, made by Sekisui Chemical Co.) | 100 g |
| Methyl ethyl ketone | 12 1 |

The CGL-1 coating solution components, obtained when the above components were dispersed for 20 hours with a sand mill, were used in this example.

TABLE 1

| No. | | Length (l) (mm) | Angle of the cut surface (θ) | ΔFilm thickness | Length of disturbance | Image unevenness |
|---|---|---|---|---|---|---|
| 1-1 | Example | 0.1 | 30 | <0.1 μm | <5 mm | No |
| 1-2 | " | " | 40 | <0.1 μm | <5 mm | No |
| 1-3 | " | " | 50 | <0.1 μm | <5 mm | No |
| 1-4 | " | " | 60 | <0.1 μm | <5 mm | No |
| 1-5 | " | " | 70 | <0.1 μm | <5 mm | No |
| 1-6 | " | " | 80 | <0.1 μm | <5 mm | No |
| 1-7 | Comparative Example | " | 25 | 0.8 μm | about 50 mm | Yes |
| 1-8 | Comparative Example | " | 85 | 0.9 μm | about 65 mm | Yes |

As can clearly be seen from the results in Table 1, samples, obtained by coating the solution using the methods in which θ is in the range of 30° through 80°, disturbance of the film thickness (Δ film thickness) after coating and drying is small; the disturbance length, in which the coating solution in the coating region is disturbed after the coating apparatus has passed through the region of the cut surface 12A, is also small; and image unevenness does not occur during the image formation process. In contrast to this, the following is found in the sample, obtained when the coating solution was coated at θ of 25°: Δ film thickness is large; the disturbance length is also large; and further, the coating solution bead is lost, resulting in unstable coating. In the sample obtained when coating was carried out at θ of 85°: Δ film thickness is large; the disturbance length is large; further, the coating solution bead is lost; a large amount of the coating solution enters the groove 11B, and the film thickness becomes large; the drying process takes an excessively long period of time, and so-called solution oozing occurs, resulting in uneven coating.

EXAMPLE 2

Polyvinyl butyral and CGM (charge generation material) were added in a ratio of 1:2 (weight ratio) to 2-butanone to give 2.5 weight/volume % of the solid content and dispersed for 20 hours in a sand grinder to obtain the coating dispersion 2. The viscosity of the dispersion solution was 10 cp. The coating solution was coated and dried so that a dried film of 1.0 μm thickness was formed, at a coating speed of 15 mm/sec by the ring-shaped coating apparatus 3 shown in FIG. 1. Dimensions of the cylindrical drums 1A and 1B, which were the objects to be coated, were ϕ80×L355.5 mm. The length of the cut surface 12A was set successively to be 0.1 mm and 0.3 mm. The cut surface angle (θ) with respect to the horizontal surface of the cylindrical drums 1A and 1B was in the range of 40° to 80°, wherein the horizontal surface in the direction of the diameter of drum was used as the reference. Results obtained from this example are shown in Table 2.

The following material CGM-1 was used as the above-described CGM.

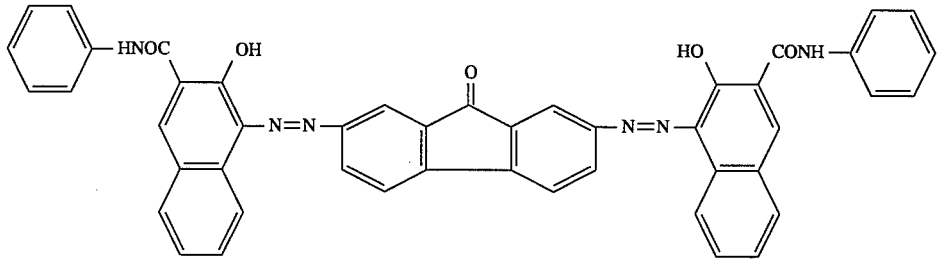

CGM-1

TABLE 2

| Sample No. | Angle of the cut surface θ | Length of the cut surface D (mm) | l (mm) | ΔFilm thickness | Length of disturbance | Image unevenness |
|---|---|---|---|---|---|---|
| 7 | 40° | 0.10 | 0.077 | <0.1 μm | <5 mm | No |
| 8 | 60° | 0.30 | 0.15 | <0.1 μm | <5 mm | No |
| 9 | 80° | 0.30 | 0.052 | <0.1 μm | <5 mm | No |
| 10 | 20° | 0.30 | 0.28 | 0.8 μm | about 50 mm | Yes |

Sample Nos. 10 is comparative examples.

EXAMPLE 3

In this example, the photoreceptor was produced by the process in which: the ring-shaped coating apparatus 3 shown in FIG. 1 is used; and the under-coat layer, CGL and CTL are successively coated so that a multi-layer is formed.

| | |
|---|---|
| (1) Coating solution components for under-coat layer (UCL-1) | |
| copolymer nylon resin (CM-8000, made by Toray Co.) | 300 g |
| Methanol/n-butanol (9/1 vol ratio) | 10 l |
| (2) CGL coating solution components (CGL-1) | |
| The same coating solution components as those used in Example 1 | |
| (3) CTL coating solution components (CTL-1) | |
| CTM-1 | 5.0 Kg |
| polycarbonate resin (Z-200, made by Mitsubishi Gas Chemical Co.) | 5.6 Kg |
| 1, 2-dichloroethane | 28 l |

In this example, the photoreceptor was produced by the following processes in which: these coating solution components are successively coated on an aluminum drum having a diameter is 80 mm, a length of 355 mm, and a peripheral wall thickness of 1.25 mm; the coating solution components are sequentially coated on the drum so that a multi-layer is formed, in the order of (1), (2) and (3), which are described above, in such a manner that the thickness of the dried films are respectively 0.5 μm, 0.5 μm, and 25 μm.

In this experiment, the length (l) was changed as listed in the following Table 3, and the angle (θ) formed between the cut surface and the horizontal surface in the diameter of the drum was fixed at 45°.

Results obtained from this experiment are shown in Table 3.

TABLE 3

| No. | | l (mm) | θ | ΔFilm thickness | Length of disturbance | Image unevenness |
|---|---|---|---|---|---|---|
| 3-1 | Example | 0.01 | 45° | <0.1 μm | <5 mm | No |
| 3-2 | " | 0.05 | " | <0.1 μm | <5 mm | No |
| 3-3 | " | 0.10 | " | <0.1 μm | <5 mm | No |
| 3-4 | " | 0.15 | " | <0.1 μm | <5 mm | No |
| 3-5 | " | 0.20 | " | <0.1 μm | <5 mm | No |
| 3-6 | " | 0.30 | " | <0.1 μm | <5 mm | No |
| 3-7 | " | 0.007 | " | 0.3 μm | about 10 mm | Slightly Yes |
| 3-8 | Comparative Example | 0.35 | " | 0.9 μm | about 65 mm | Yes |

From results in Table 3, the following are found. When l is not more than 0.3 mm, in the produced photoreceptor, disturbance in the film thickness (Δ film thickness) after coating and drying is small; the length of disturbance of the coating solution in the coating region after the coating apparatus has passed the region of the cut surface 12A is also small; and after images were formed, image unevenness was not found, as will be described later.

Samples from Sample Nos. 3-1 to 3-8 in Table 3 obtained by the above processes were respectively installed in a copier, U-Bix 4045 (produced by Konica Co.), and actual copy testing was carried out. Then, the image was evaluated by visual observation. As a result of this observation, no remarkable problems were not found in Sample Nos. 3-1 to 3-6. However, image unevenness was found on end portions of the recording sheet in Sample No. 3-8.

The CTM-1 (Charge Transport Material) used in this example has the following chemical structure.

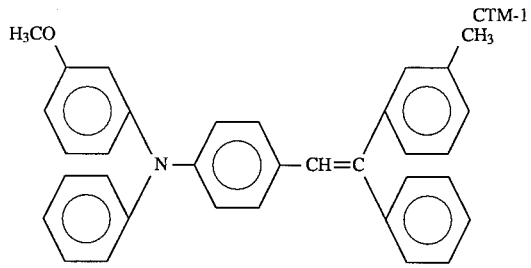

Since the present invention is structured as described above, when the coating solution such as a photosensitive solution and the like, is continuously coated on a plurality of cylindrical drums, which are vertically stacked, the movement of the coating solution toward the following cylindrical drum can be prevented, so that a uniform coated layer, such as a photosensitive layer, can be formed by the present invention.

What is claimed is:

1. A method of manufacturing an electrophotographic photoreceptor drum, the method comprising the steps of:

(a) aligning cylinder shafts of a plurality of cylindrical drums with each other, each drum having a chamfered face formed at an end thereof;

(b) contacting circular ends of the drums with each other and stacking the drums on each other; and (c) continuously coating photoreceptor material on circumferential surfaces of the drums while inserting the drums into a ring-shaped coater and moving the ring-shaped coater vertically from an upper portion to a lower portion of the stacked drums, wherein each of the drums satisfying the following inequalities at the same time is used:

$$30° \leqq \theta \leqq 80°, \text{ and } l \leqq 0.3 \text{ mm}$$

where θ represents an angle between an extension line of the chamfered face formed at an edge of the drum and an extension line of a circular end of the drum, and l represents a distance between an intersecting point of the circular end and the chamfered face of the drum, and an extension line of a circumferential surface of the drum.

2. The method of claim 1, wherein said angle is from 45° to 80°.

3. The method of claim 1, wherein said distance is not less than 0.01 mm.

4. The method of claim 2, wherein said distance is not less than 0.01 mm.

* * * * *